United States Patent [19]

Sellge, Jr. et al.

[11] 4,258,915

[45] Mar. 31, 1981

[54] SELF-LOCKING PORTABLE SUPPORT STRUCTURE

[76] Inventors: Hans Sellge, Jr., San Francisco; Tom M. Browne, Berkeley, both of Calif.

[21] Appl. No.: 45,057

[22] Filed: Jun. 4, 1979

[51] Int. Cl.[3] ..... A63B 7/08

[52] U.S. Cl. ..... 272/111; 248/163

[58] Field of Search ..... 272/62, 63, 111, 93, 272/109; 248/127, 163; 211/182

[56] References Cited

U.S. PATENT DOCUMENTS

| | | | |
|---|---|---|---|
| 714,554 | 11/1902 | Augustus | 272/62 |
| 2,893,767 | 7/1959 | Buchman . | |
| 2,932,510 | 4/1960 | Kravitz . | |
| 3,201,119 | 8/1965 | Fenner et al. . | |
| 3,384,332 | 5/1968 | Fenner et al. . | |
| 3,384,368 | 5/1968 | Fenner et al. | 272/62 |
| 3,430,954 | 3/1969 | Massey . | |
| 3,561,564 | 2/1971 | Russell | 272/65 |
| 3,653,658 | 4/1972 | Robertson | 272/62 X |
| 3,944,219 | 3/1976 | Lopresti . | |

FOREIGN PATENT DOCUMENTS

| | | | |
|---|---|---|---|
| 857754 | 12/1970 | Canada | 272/62 |

*Primary Examiner*—William R. Browne

*Attorney, Agent, or Firm*—Limbach, Limbach & Sutton

[57] ABSTRACT

A portable support structure is disclosed having a horizontal member and single upright supports suitably connected at each end thereof at an angle of less than 90° so that the upright supports are directed inwardly. Without additional bracing, this support structure is able to withstand applied forces to the horizontal bar and exhibits a high degree of stability in use. The support is particulary suitable for ballet barres and gymnastic equipment.

16 Claims, 12 Drawing Figures

SELF-LOCKING PORTABLE SUPPORT STRUCTURE

BACKGROUND OF THE INVENTION

Ballet barres are utilized by dancers throughout the world as an exercising tool to advance their particular type of dancing skill. The barre offers a physical support allowing the dancer to perform a variety of dancing exercises which include pulling and pushing on a barre, supporting the weight of dancer and balancing the body by holding onto the barre. To function properly a barre should be sufficiently stable for any exercise to allow a dancer to use the barre with confidence. Only then can the dancer effectively advance his technical ability.

Existing ballet barres are either permanently installed on studio walls or are portable depending on availability of space or personal preference. A permanently installed barre offers two distinct advantages over portable barres. First, because it is physically attached to the wall, it offers firm and rigid support during practice. Second, it normally consists of wood which is elastic in nature and is therefore flexible, absorbs body oils and consequently feels "warm," "soft," and "live" during use. The primary disadvantage of this kind of barre is that exercises are restricted to floor surfaces adjacent to the studio walls.

The primary functions of a portable ballet barre is similar to the permanent type. Portable barres, in addition offer distinct advantages over permanent barres. Exercises can be performed on any portion of the dance floor, thus maximizing use of floor space. Portable barres can be utilized on both sides and therefore increase the number of dancers utilized per barre. A properly designed portable ballet barre can significantly maximize the use of floor space of a studio.

SUMMARY OF THE INVENTION

It is therefore an object of the invention to provide an improved portable support structure.

Another object of the invention is to provide a highly stable portable support particularly suitable as a ballet barre and for use with gymnastic equipment.

Another object of the invention is to provide a ballet barre which minimizes tipping during normal use and is elastic in nature.

Another object of the invention is to provide a ballet barre where vertical forces exerted by dancers lock the barre directly into the dance floor, thereby preventing barre movement along the floor.

In accordance with the present invention a portable support structure comprises a horizontal cross member connected to a pair of uprights at an angle $\phi$, which is less than 90°. Each upright in turn is connected to a pre-bent floor support which is symmetrical to the upright axis.

Such a support structure can be used as a gymnastic equipment and has applications in the construction industry, where a portable, highly stable support is desired which does not require bracing. One particularly suitable use is as a portable ballet barre. For purposes of further description of the invention, its application as a ballet barre is described.

A ballet barre made in accordance with the invention provides excellent stability. Normal pulling and pushing exercises can be performed on the barre by a dancer without barre movement along the floor. Applied vertical forces effectively lock the barre to the dance floor allowing the dancer to exercise with confidence. A ballet barre in accordance with the invention utilizes built-in springs at the junction of the horizontal member and each of the uprights and at the junction of each floor support and upright to simulate the elastic quality of wood utilized in permanently installed ballet barres. These springs function as a result of vertical forces applied to the barre components.

DESCRIPTION OF THE PREFERRED EMBODIMENT(S)

Figure 1:
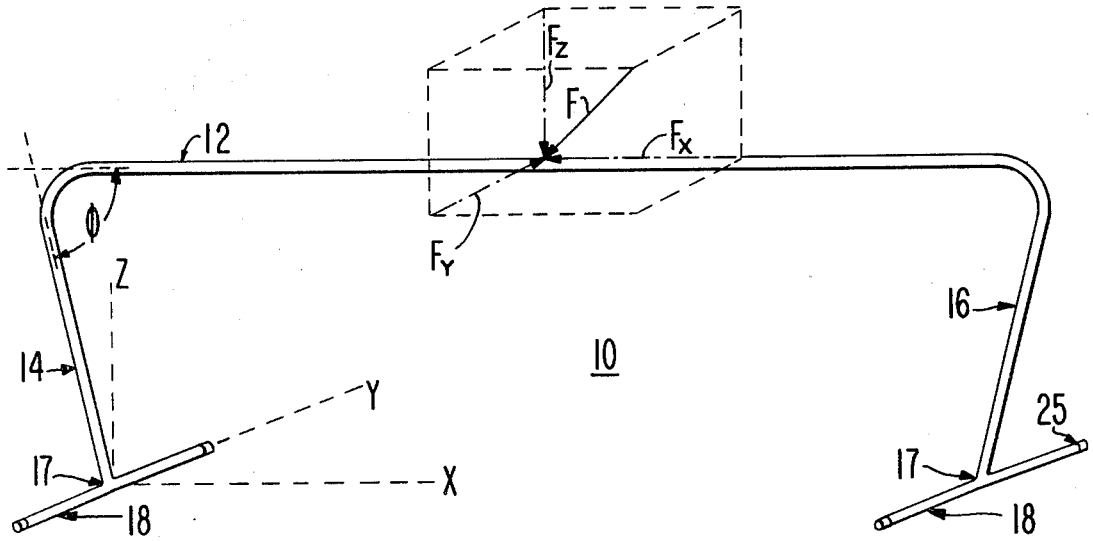
FIG. 1 is a perspective view of a ballet barre in accordance with the present invention.
Figure 2A:
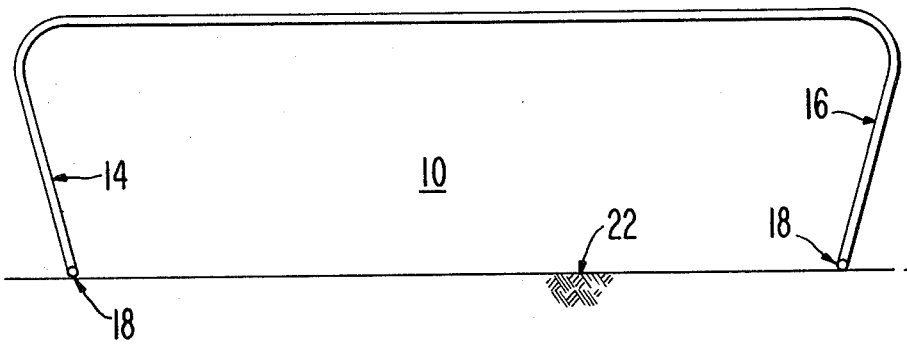
FIGS. 2A and 2B are, respectively, front and end views of the ballet barre of FIG. 1.
Figure 2B:
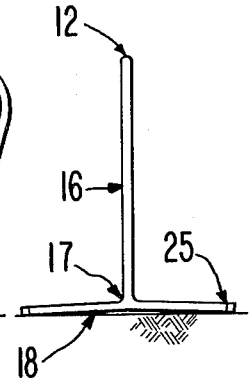

FIGS. 1, 2A and 2 show a portable ballet barre 10 in accordance with the present invention. A horizontal cross member 12 is formed with or connected to uprights 14 and 16 at a critical angle $\phi$. Cross member 12 and uprights 14 and 16 can be formed from a single piece of tubing for example, or may be formed by separate uprights attached to the cross member 12. Either way, the junction thereby formed follows a generally curved contour as shown.

Joined at 17 to the uprights 14 and 16 are pre-bent floor supports 18 which are symmetrical to the upright axis. By pre-bent it is meant that the junction point 17 is elevated slightly and therefore the weight of the barre is carried at each end of the floor support 18. In other words the angle defined by the end points of floor support 18 and the junction point 17 is slightly less than 180°.

The specific reasons for selecting the critical connection between the cross member 12 and upright supports 14 and 16, and the upright connection to the floor supports 18 is now explained.

Analysis of applied forces on ballet barres indicate that the angle of construction between the cross-member and the upright is an important consideration in barre construction. This angle is important in the transmission of forces along barre components. In FIG. 1 the cross-member 12 is represented by the x coordinate, the upright by the z direction, and the floor support 18 in the y direction. The applied force is F with vertical force component Fz. The criteria for barre stability is to prevent the movement of the floor support 18 in the x and y directions resulting from Fz.

Figure 3A:
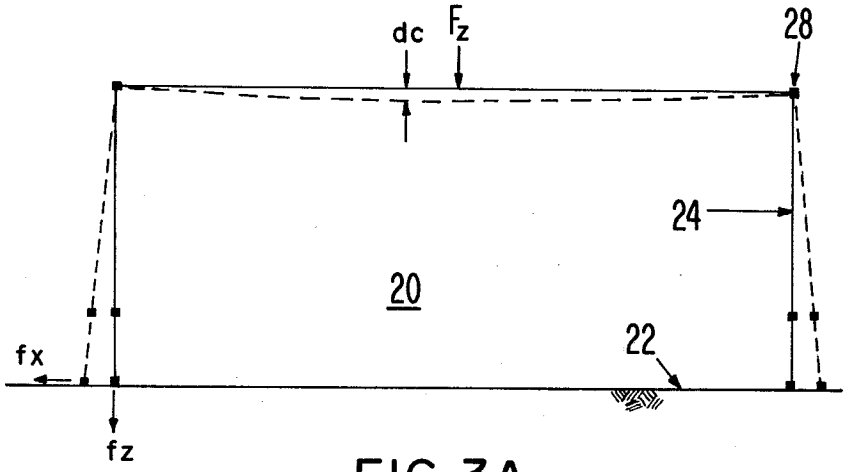
FIGS. 3A and 3B are schematic representations of a typical prior art ballet barre illustrating the effects of vertically applied forces.
Figure 3B:
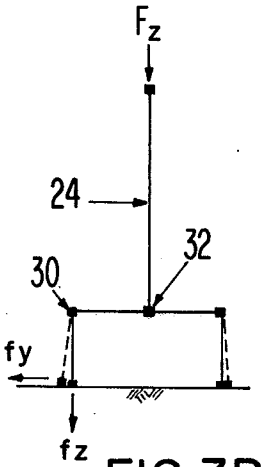

FIGS. 3A and 3B show schematically the general construction of a conventional ballet barre 20, sitting on floor 22. The upright support 24 is at an initial angle of 90°. When a force Fz is applied to the cross-member 26, it deflects a distance dc and causes a force moment (mf) about axis point 28. This in turn transfers the forces along the upright 24 and transmits Fz partly into the floor 22 as fz and the remainder is transmitted along the floor as fx and fy. These transmitted forces cause the uprights and floor supports to move outwardly along the floor. Sufficient forces such as the full weight application of a dancer or a strong pull can cause such a conventional barre 20 to collapse.

As force Fz is transmitted along the barre, a force moment is created around points 28, 30, and 32 as shown in FIGS. 3A and B. Since components are connected at 90°, force flow lines are abruptly changed resulting in high stress concentrations around junctions. Consequently, in conjunction with repeated upright and floor support movement, these stress concentrations are normally sufficient to loosen fittings. This joint fatigue can easily crack plastic connections and causes normal steel treaded fittings or compression type fittings to loosen relatively quickly. Consequently conventional barres lose stability very rapidly.

Figure 4A:
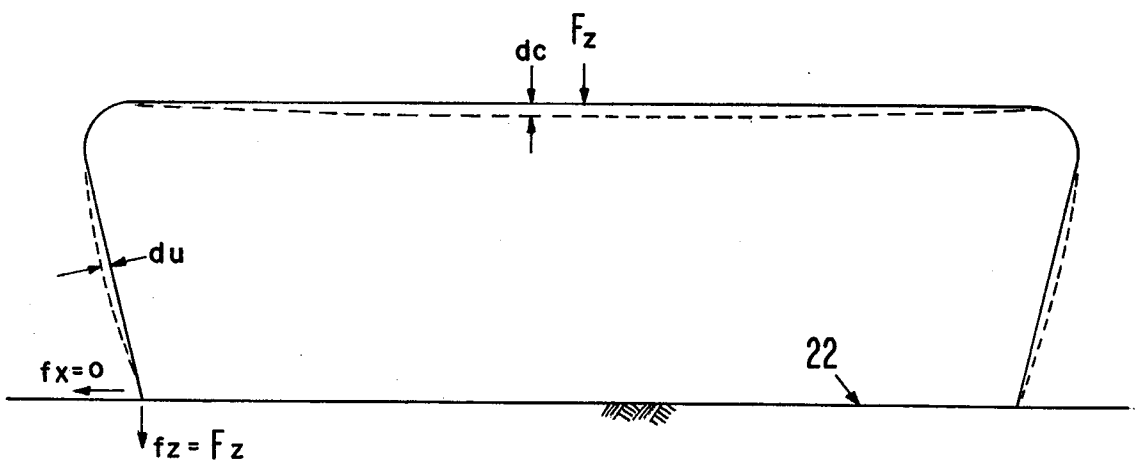
FIGS. 4A and 4B are schematic representations of the ballet barre of the present invention illustrating the effects of vertically applied forces.
Figure 4B:
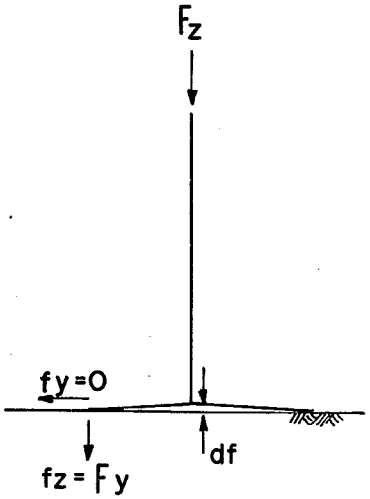

However, the situation is different for a ballet barre in accordance with the present invention. Referring to FIGS. 4A and 4B, when force Fz is applied to the cross member 12 it deflects the cross member a distance dc and the uprights 14 and 16 a distance du. However, because the uprights 14 and 16 are at an angle $\phi$ to the horizontal cross bar 12 which is less than 90°, all of the transmitted force is directed perpendicularly into the floor 22. The transmitted horizontal force components fx and fy become zero which indicates that the floor supports 18 and uprights 14 and 16 cannot move. Therefore Fz locks the barre 10 into the floor 22.

Figure 5A:
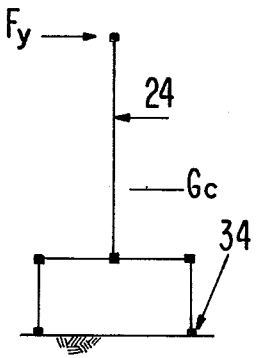
FIG. 5A is the same as FIG. 3B showing the effects of horizontally applied forces.
Figure 5B:
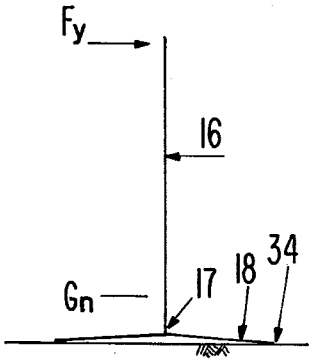
FIG. 5B is the same as FIG. 4B illustrating the effects of horizontally applied forces.

The design of the floor supports 18 and their connection to the uprights 14 and 16 is an important feature of the present invention. In FIG. 5A conventional barre 20 is shown and in FIG. 5B barre 10 of the present invention is shown. Horizontal applied force vector Fy represents pulling or pushing forces exerted by a practicing dancer. In either case, if Fy is sufficiently large, the barre will tip about end point 34. It can be shown that this tipping force, Fy, is inversely proportional to the height of the barre's center of gravity, G, and directly proportional to the length of the floor supports.

Barre 10, in accordance with the present invention, has a lower center of gravity by locating its geometric center of gravity near floor level and by material selection. Thus the floor supports 18 and uprights 14 and 16 are constructed of heavy steel pipe sections while the cross member 12 consists of light weight steel tubing. Conventional barres 20 exhibit a high geometric center of gravity as shown in FIG. 5A and are normally constructed of materials that are uniform in all barre components. They, therefore, tip over with relative ease.

In addition, the geometric shape of the floor support 18 is designed to contribute to barre 10 elasticity. The floor support 18 is bent at its center 17 (FIGS. 2B and 5B) to a predetermined angle, slightly less than 180°. Only the ends of floor support 18 are in contact with the floor. Ends of floor support 18 are covered with rubber sleeve 25. When force Fz is applied to the cross member 12, the floor support 18 is caused to deflect a distance df.

The advantage of the elasticity provided by the barre 10 is now described. An important feature of any functional ballet barre is how the barre "feels" during use by a dancer. A portable barre that provides a "soft" touch similar to the permanent barres constructed of wood is preferred. Rigid metal barres are not preferred since they provide a "hard" metal contact. Essentially dancers preferred the "live" nature of wood which technically is referred to as the elasticity of wood.

Although the barre 10 of the present invention does not move along the dance floor, it is designed to deflect under a force Fz. This deflection in conjunction with smooth force transmission, results in a highly elastic ballet barre, one which essentially duplicates the "live" quality inherent in the nature of wood barres. Vertical forces cause the cross-member 12 to deflect and since the floor support is locked into the dance floor, the uprights 14 and 16 and floor supports 18 also deflect and transmit the remaining forces directly into the floor. None of these are permanent deformation type of deflections and once vertical force is eased, the barre 10 automatically assumes its original shape. It should be noted that these deflections are relatively small individually. However, in combination the barre 10 provides a very "live" support for the dancer.

The complete transmission of vertically applied forces into the floor is possible theoretically only at critical angle $\phi c$. However, $\phi c$ is confined to a precise value only theoretically where friction between barre components and floor is non-existent. In actual use, friction does exist between barre and the floor and therefore angle $\phi$ exhibits a range of values. However, as Fz increases to overcome this friction, barre movement occurs at excessive values of $\phi$. In actual barre 10 construction upper and lower limits of this critical angle range depend upon the desired degree of barre elasticity, and the degree of friction between barre and floor. Rubber sleeves 25 over ends of floor support 18 serve to increase the range of critical angle $\phi c$.

Figure 6:
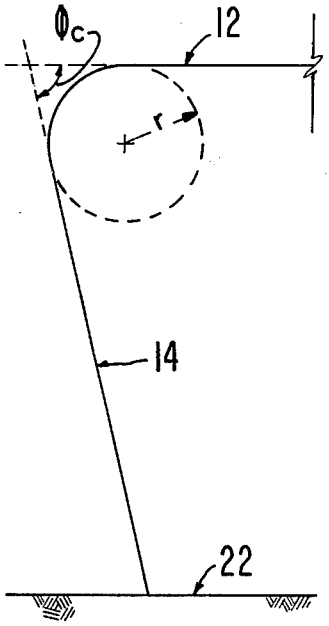
FIG. 6 is a schematic representation of one upright and the horizontal cross member of the barre of FIG. 1.

To determine the upper and lower limit of the angle $\phi$ which effectively locks barre 10 in place, a mathematical model is established to allow the calculation of $\phi c$ and the practical range of construction angles. This mathematical model sets forth an empirical formula which relates $\phi c$ to the height h of the uprights 14 and 16 and a proposed radius r of construction between the uprights 14 and 16 and the cross member 12, as shown in FIG. 6. This proposed radius of construction serves to smoothly transmit applied force F and effectively acts as a spring, which increases the desired elastic effect of the device. In terms of mathematics, the radius of construction is a measurement of the degree of elasticity of the device. Given a set of material selection, a large radius implies greater spring constant, therefore greater deflection. Therefore the critical angle $\phi c$ can be expressed as:

$$\phi c = f(h.r)$$

Figure 7:
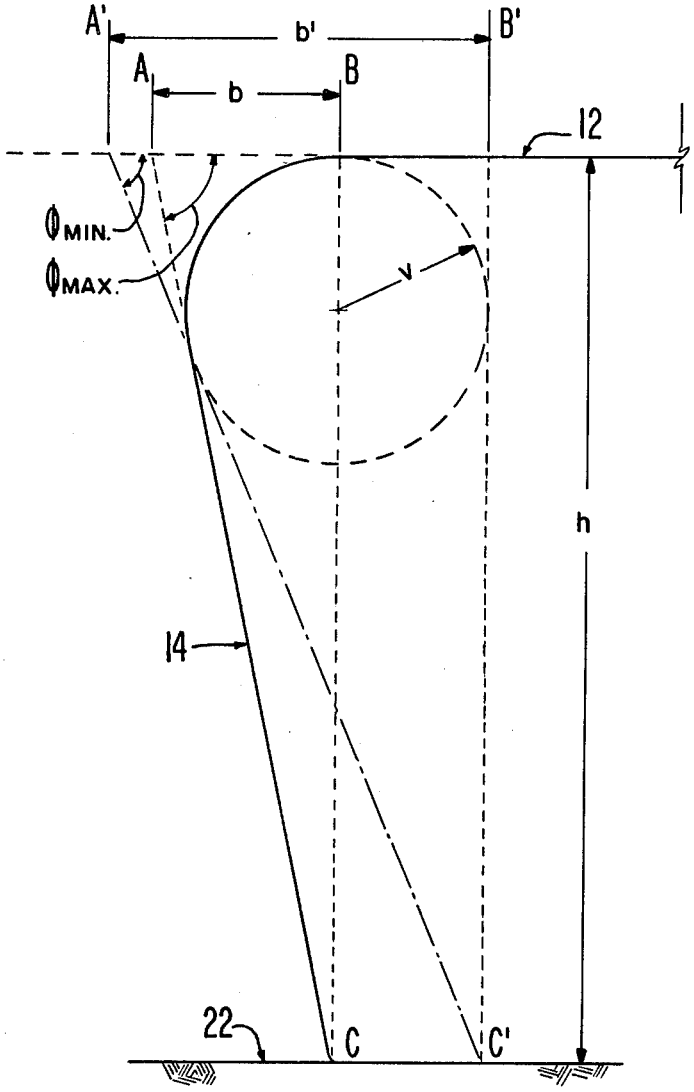
FIG. 7 is a schematic representation of the barre of FIG. 1 illustrating the graphical model used in obtaining the mathematical relationship defining the upright support angle.

This general relationship can be expressed more precisely following an analysis of this interdependency. As shown in FIG. 7, device components form right triangle ABC where AB is perpendicular to BC, C is the floor contact point and line BC is drawn perpendicularly to the floor 22 and intersects the centerline of the circle formed by radius r. Line AC is drawn tangent to the circle and forms angle $\phi$ at the junction of AC and AB.

Angle $\phi$ can be expressed as follows:

$$\tan \phi = h/b \quad (1)$$

where tan $\phi$ = tangent of $\phi$
h = device height
b = distance between A & B Since b is approximately equal to the radius of construction r, r can be substituted into the above equation (1) to provide the following empirical equation:

$$\tan \phi = h/r \quad (2)$$

or $$\phi \simeq \tan^{-1} (h/r) \quad (3)$$

It should be noted that point B is directly perpendicular to point C where BC represents the visual perpendicular line of force transmission.

Tests conducted to determine floor support movement indicated that the floor supports virtually stopped at this angle, and an increase in angle $\phi$ showed an increased floor support movement. Consequently this angle is defined to represent the maximum angle $\phi$ that effectively locks the floor supports 14 and 16 into the floor. Expressed mathematically:

$$\phi \max \simeq \tan^{-1} (h/r) \quad (4)$$

Tests indicate that the locking mechanism is effective over a small range of angles. Experimental data indicates that once the angle was decreased to beyond point C', as in FIG. 7, considerable floor support movement was again evidenced. Therefore, the angle formed by locating the upright to point C' was defined to be the minimum angle $\phi$ of construction. FIG. 7 shows this angle, $\phi$ min, to be formed by right triangle A'B'C' where B'-C' is shown tangent to the circle formed with radius r and is perpendicular to the floor. Similar analysis shows that this angle $\phi$ min is defined by $$\tan \phi \min = h/b' \quad (5)$$

where b' = the distance of A' to B'.

Since b' is approximately equal to the diameter of the circle of construction or twice the radius r, the value 2r can be substituted for b to give $$\tan \phi \min = h/2r \quad (6)$$

or $$\phi \min = \tan^{-1} (h/2r) \quad (7)$$

Since equations (4) and (7) represent maximum and minimum values of support angle $\phi$, it is concluded, that the critical support angle $\phi c$ is located half way between the two limits and can be expressed mathematically as $$\phi c = \frac{\tan^{-1} \frac{h}{r} + \tan^{-1} \frac{h}{2r}}{2} \quad (8)$$

A distribution curve showing floor support movement against angle $\phi$ verified this conclusion.

In principle the locking mechanism described can function over an infinite range of $\phi$, h, and r values. However, in actual applications, there are limitations to this relationship, and these limitations are dictated by the degree of elasticity of device components, and the degree of the desired flexibility of the device. For example, a small radius r can be utilized in combination with a large angle $\phi c$, approaching the maximum value of 90°. However, this will function only if components exhibit little flexibility from force application. Ultimately, an infinitely small radius requires a 90° angle of construction, and this functions only if components are perfectly rigid. Any reflection will cause instability. Or a large radius can be utilized in combination with a small angle $\phi$. An infinitely small angle requires that the height h of the device is equal to twice the radius r. In this case upright 14 of the barre 10 is in the shape of a semi-circle. This condition is suitable for a device requiring maximum elasticity as the entire upright 14 behaves like a spring.

Figure 8:
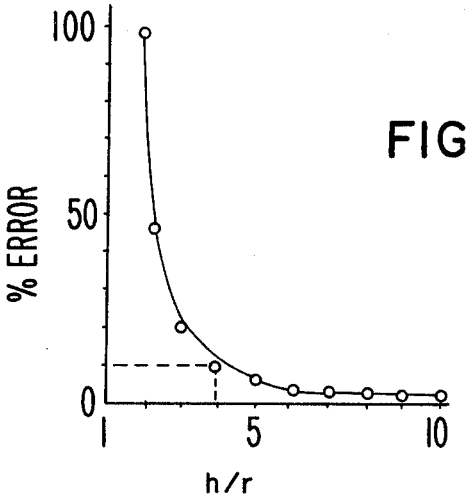
FIG. 8 is a graphical illustration relating to the accuracy of proposed empirical relationship defining the upright support angle.

The empirical relationship defining the critical angle $\phi$ in equation (8) is relatively accurate at large ratios of h:r. However at small ratios this equation increases in error, and an accurate measurement of angle $\phi$ should be determined graphically. The actual angle $\phi$ is determined by equation (1): $\tan \phi = h/b$. At relatively large angles up to 90°, b is approximately equal to r and can therefore be reasonably substituted in the equation. As angle $\phi$ decreases, the value of b increases rapidly and cannot be accurately substituted for r. Consequently equation 2 is no longer valid at these small angles. The error between the two equations (1) and (2) is plotted in FIG. 8 against the ratio h/r. Based on this graph, and assuming a reasonable upper limit of error of 10%, the lower limits the equation is confined to a h/r value of four. Therefore the empirical equation (8) can be utilized within a 10% error in calculations where $4 \leqq (h/r) < \infty$. Any determination of angle $\phi$ where $2 \leqq h < 4$ should be performed graphically.

What is claimed:

1. A ballet barre comprising:

a horizontal cross member for supporting a user during an exercise;

only a single upright support connected at each end of said horizontal cross member at an angle $\phi$ thereto:

a floor support connected at the distal end of each of said upright supports;

joint connection means between said horizontal member and each upright support such that the angle $\phi$ therebetween is chosen to transmit forces from the horizontal member through said upright supports such that all forces are resolved into only one substantially vertical-resulting force at the respective distal end of each of said upright supports to reduce any tipping effect caused by the forces produced by the user during use; and wherein said angle $\phi$ is chosen to be less than 90° such that the distal ends of said upright supports point inwardly towards each other.

2. A ballet barre as in claim 1 wherein the two ends of each of said floor supports and the junction of each support with said upright support defines an angle slightly less than 180°.

3. A ballet barre as in claim 2 wherein the ends of said floor supports are terminated with a high friction material.

4. A ballet barre comprising:

a horizontal member for supporting a user during an exercise;

a single upright support member of vertical height h supporting said horizontal member at each end thereof, with said horizontal member and each of said horizontal member and each of said upright members forming an angle $\phi$;

joint connection means between said horizontal member and each upright support such that the angle $\phi$ therebetween is chosen to transmit forces from the horizontal member through said upright supports such that all forces are resolved into only one substantially vertical-resulting force at the respective distal end of each of said upright supports to reduce any tipping effect caused by the forces produced by the user during use; with the junction of each upright member and said horizontal member defining an arc of a circle with radius r;

a floor support connected at the distal end of each of said upright members; and wherein said angle $\phi$ is chosen to be slightly less than 90° such that the distal ends of said upright supports point inwardly towards each other.

5. A ballet barre as in claim 4 wherein the angle $\phi$ falls within a range of about $\phi$ min to $\phi$ max, where $\phi$ min and $\phi$ max are defined by the relationships:

$$\phi \max = \tan^{-1}(h/r)$$

$$\phi \min = \tan^{-1} h/2r$$

where the ratio of h/r falls within the range of $4 \leqq (h/r) < \infty$.

6. A ballet barre as in claim 4 wherein the critical angle $\phi c$ is approximately equal to about $$\frac{\tan^{-1}\frac{h}{r} + \tan^{-1}\frac{h}{2r}}{2} \text{ for } 4 \leqq \frac{h}{r} < \infty$$

7. A ballet barre as in claim 4 wherein for $2 \geqq (h/r) < 4$ the angle $\phi$ is determined graphically.

8. A ballet barre as in Claim 4, 5, 6 or 7 wherein the two ends of each of said floor supports and the junction of each floor support with said upright members defines an angle of less than 180°.

9. A support structure including:

a horizontal cross member for supporting a load;

only a single upright support connected at each end of said horizontal cross member at an angle $\phi$ thereto:

a floor support connected at the distal end of each of said upright supports;

joint connection means between said horizontal member and each upright support such that the angle $\phi$ therebetween is chosen to transmit forces from the horizontal member through said upright supports such that all forces are resolved into only one substantially vertical-resulting force at the distal end of said upright supports to reduce any tipping effect caused by the forces produced by a load during use; and wherein said angle $\phi$ is chosen to be less than 90° such that the distal ends of said upright supports point inwardly towards each other.

10. A support structure as in claim 9 wherein the two ends of each of said floor supports and the junction of each support with said upright support defines an angle slightly less than 180°.

11. A ballet barre as in claim 10 wherein the ends of said floor supports are terminated with a high friction material.

12. A support structure comprising:

a horizontal member for supporting a load;

a single upright support member of vertical height h supporting said horizontal member at each end thereof, with said horizontal member and each of said upright members forming an angle;

joint connection means between said horizontal member and each upright support such that the angle $\phi$ therebetween is chosen to transmit forces from the horizontal member through said upright supports such that all forces are resolved into only one substantially vertical-resulting force at the distal end of said upright supports to reduce any tipping effect caused by the forces produced by a load during use, with the junction of each upright member and said horizontal member defining an arc of a circle with radius r;

a floor support connected at the distal end of each of said upright members; and wherein said angle $\phi$ is chosen to be slightly less than 90° such that the distal ends of said upright supports point inwardly towards each other.

13. A support structure as in claim 12 wherein the angle $\phi$ falls within a range of about $\phi$ min to $\phi$ max, where $\phi$ min and $\phi$ max are defined by the relationships:

$$\phi \max = \tan^{-1}(h/r)$$

$$\phi \min = \tan^{-1}(h/2r)$$

where the ratio of h/r falls within the range of $4 \leqq (h/r) < \infty$.

14. A support structure as in claim 12 wherein the critical angle $\phi c$ is approximately equal to about $$\frac{\tan^{-1}\frac{h}{r} + \tan^{-1}\frac{h}{2r}}{2} \text{ for } 4 \leqq \frac{h}{r} < \infty$$

15. A support structure as in claim 12 wherein for $2 \geqq (h/r) < 4$ the angle $\phi$ is determined graphically.

16. A support structure as in claim 12, 13, 14 or 15 wherein the two ends of each of said floor supports and the junction of each floor support with said upright members defines an angle of less than 180°.

* * * * *